US009033463B1

(12) United States Patent
Kondo

(10) Patent No.: US 9,033,463 B1
(45) Date of Patent: May 19, 2015

(54) PRINTER

(71) Applicant: Brother Kogyo Kabushiki Kaisha, Nagoya-shi (JP)

(72) Inventor: Kazuyuki Kondo, Kuwana (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/469,974

(22) Filed: Aug. 27, 2014

(30) Foreign Application Priority Data

Feb. 5, 2014 (JP) ..... 2014-020197

(51) Int. Cl.
*B41J 23/00* (2006.01)
*B41J 25/00* (2006.01)
*B41J 11/00* (2006.01)
*B41J 11/20* (2006.01)

(52) U.S. Cl.
CPC ..... *B41J 25/001* (2013.01); *B41J 11/008* (2013.01); *B41J 11/20* (2013.01)

(58) Field of Classification Search
CPC ..... B41J 11/008; B41J 11/20; B41J 19/005; B41J 25/001
USPC ..... 347/8, 37; 400/55, 58, 59
See application file for complete search history.

(56) References Cited

U.S. PATENT DOCUMENTS 5,241,325 A * 8/1993 Nguyen ..... 347/49

FOREIGN PATENT DOCUMENTS

JP 2013-22771 A 2/2013

* cited by examiner

*Primary Examiner* — Juanita D Jackson
(74) *Attorney, Agent, or Firm* — Fox Rothschild LLP

(57) ABSTRACT

A printer includes a guide shaft, a rail member, print head units, a carriage and a first pressing portion. The first pressing portion includes a first contact member, a first support shaft, a first arm member and a first urging member. The first contact member comes into contact with a first end portion. The first support shaft is disposed between a position facing one of the two support portions in a rail-side end portion and a position facing the other support portion. The first support shaft stands in a fourth direction opposite to a third direction in which an ejection portion ejects liquid. The first arm member swings around the first support shaft, and supports the first contact member on a swinging end side. The first urging member urges the first arm member in a direction in which the first contact member comes into contact with the first end portion.

5 Claims, 9 Drawing Sheets

PRINTER

CROSS-REFERENCE TO RELATED APPLICATION

This application claims priority to Japanese Patent Application No. 2014-020197 filed on Feb. 5, 2014, the disclosure of which is herein incorporated by reference in its entirety.

BACKGROUND

The present disclosure relates to a printer that performs printing by ejecting liquid onto a print medium.

An inkjet printer is known which performs printing by ejecting ink from a nozzle onto a print medium, and in which two inkjet heads that are aligned in a direction (hereinafter also referred to as a sub-scanning direction) that is orthogonal to a scanning direction are taken as one set and four sets of inkjet heads are aligned and arranged in the scanning direction. For example, each of the inkjet heads ejects one type of ink. The above-described inkjet printer is provided with a guide member (a guide shaft), which is a shaft-shaped member that extends in the scanning direction. The inkjet heads are mounted on a carriage in a state in which the four sets of inkjet heads are aligned in the scanning direction. A guide engagement portion is provided on one end side of the carriage in the direction that is orthogonal to the scanning direction. The guide engagement portion is formed to be engaged with the guide shaft. The carriage is supported with respect to the guide shaft in a state in which the guide shaft is inserted through the guide engagement portion. The carriage that is supported with respect to the guide shaft by the guide engagement portion reciprocates in the scanning direction by driving of a carriage motor.

SUMMARY

When the carriage reciprocates in the scanning direction, an acceleration in the scanning direction is applied to the carriage. The acceleration in the scanning direction that is applied to the carriage exerts a load on the carriage. The load exerted on the carriage causes the carriage to tilt in the scanning direction. In this case, as described above, the inkjet heads are provided as a set aligned in the sub-scanning direction on the carriage of the above-described related art. As a result, there is a case in which the length of the carriage in the sub-scanning direction is longer in comparison to a carriage on which only one inkjet head is mounted in the sub-scanning direction. In the case of the carriage that is relatively long in the sub-scanning direction, if the magnitude of inclination on the one end side of the carriage that is supported by the guide shaft is different from the magnitude of inclination on the other end side of the carriage that is opposite to the one end side, for example, a landing position, in the scanning direction, of ink that is ejected from each of the two inkjet heads taken as one set may not match a predicted landing position. Further, design tolerances are provided for dimensions of the guide shaft and the guide engagement portion. Therefore, in a state in which the guide shaft is inserted through the guide engagement portion, a slight wobble may occur in the carriage. Therefore, in the above-described related art, when printing is performed by the inkjet printer, the landing position of the ink with respect to the print medium is displaced from the predicted landing position and printing quality deteriorates.

Various exemplary embodiments of the general principles described herein provide a printer that is capable of inhibiting deterioration of printing quality by reducing inclination of a carriage when the carriage is moved and reducing wobble" of the carriage with respect to a guide shaft.

Exemplary embodiments herein provide a printer configured to perform printing by ejecting liquid onto a print medium that is fed in a first direction. The printer is provided with a guide shaft, a rail member, a plurality of print head units, a carriage and a first pressing portion.

The guide shaft is a shaft member having a center axis extending along a second direction. The second direction is a direction that is orthogonal to the first direction. The rail member is a rod-shaped member extending in the second direction, and is disposed facing the guide shaft. Each of the plurality of print head units has an ejection portion configured to eject the liquid toward the print medium. The plurality of print head units are arranged in the first direction on the carriage. The carriage is configured to cause the plurality of print head units to reciprocate in the second direction. The carriage includes two support portions. Each of the two support portions is provided on a shaft-side end portion such that the carriage is slidably supported along the guide shaft by the guide shaft being inserted through each of the two support portions. The shaft-side end portion is one end portion of the carriage in the first direction. The first pressing portion is provided on a rail-side end portion such that the first pressing portion presses a first end portion of the rail member, the first end portion facing the guide shaft. The rail-side end portion is an end portion of the carriage, and is on an opposite side to the shaft-side end portion in the first direction.

The first pressing portion is provided with a first contact member, a first support shaft, a first inn member and a first urging member. The first contact member is provided so as to come into contact with the first end portion. The first support shaft is disposed between a position facing one of the two support portions in the rail-side end portion and a position facing the other of the two support portions. A third direction is a direction in which the ejection portion ejects the liquid. A fourth direction is a direction that is opposite to the third direction. The first support shaft stands in the fourth direction. The first arm member is supported such that it swings around the first support shaft. The first arm member is provided so as to support the first contact member on a swinging end side that is an opposite side to the first support shaft side. The first urging member is provided so as to urge the first arm member in a direction in which the first contact member comes into contact with the first end portion.

BRIEF DESCRIPTION OF THE DRAWINGS

Exemplary embodiments will be described below in detail with reference to the accompanying drawings in which.

DETAILED DESCRIPTION

Hereinafter, an embodiment will be explained with reference to the drawings. First, a schematic structure of a printer 1 will be explained with reference to FIG. 1 and FIG. 2. Note that the upper side, the lower side, the lower right side, the upper left side, the upper right side and the lower left side of FIG. 1 respectively correspond to the upper side, the lower side, the front side, the rear side, the right side and the left side of the printer 1.

Figure 1:
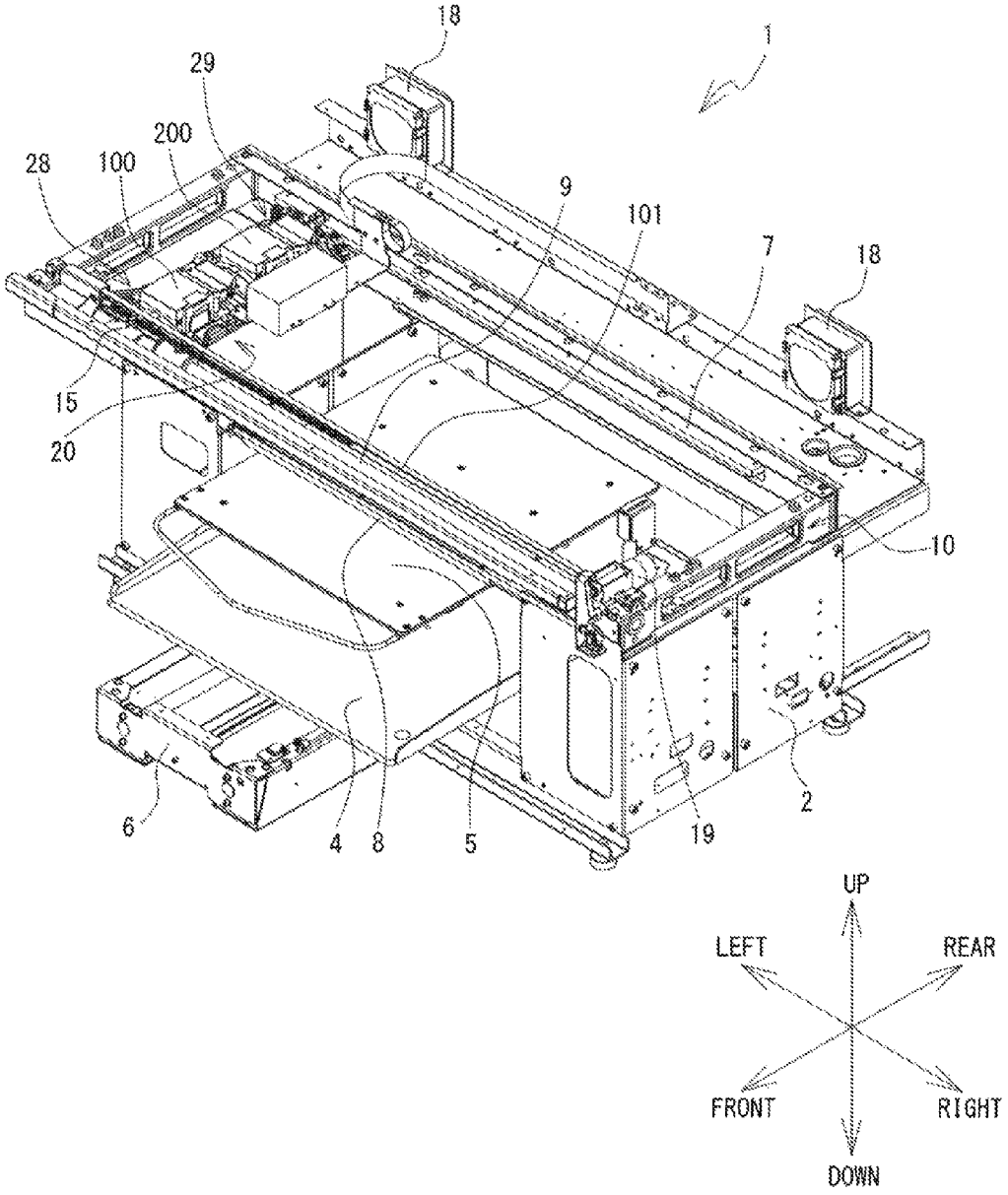
FIG. 1 is a perspective view of a printer.

As shown in FIG. 1, the primer 1 is an inkjet printer that performs printing by ejecting liquid ink onto a cloth (such as a T-shirt or the like, not shown in the drawings), which is a print medium. The printer 1 may use paper etc. as the print medium. In the present embodiment, the printer 1 can print color images on the print medium by downwardly ejecting five types of ink (white (W), black (K), yellow (Y), cyan (C) and magenta (M) inks) that are different from each other. In the explanation below, of the five types of ink, the white color ink is referred to as a white ink, and the inks of the four colors of black, cyan, yellow and magenta are collectively referred to as color inks. In the explanation below, the feed direction (the front-rear direction, the sub-scanning direction) in which the printer 1 feeds the print medium is also referred to as a first direction, and a direction (the left-right direction, the scanning direction) that is orthogonal to the first direction is also referred to as a second direction.

The printer 1 mainly includes a housing 2, a platen drive mechanism 6, a pair of guide rails 3 and 3, a platen 5, a tray 4, a frame body 10, a clearance sensor 8, a guide shaft 9, a rail 7, a carriage 20, support portions 21L and 21R, head units 100 and 200, a drive belt 101, a drive motor 19, a board 15 and two fans 18 and 18.

The housing 2 has a substantially cuboid shape that is long in the left-right direction. An operation portion (not shown in the drawings) to perform operations of the printer 1 is provided in a position on the front right side of the housing 2. The operation portion is provided with a display and operation buttons. The display displays various types of information. The operation buttons are operated when a user inputs commands relating to various types of operations of the printer 1.

Figure 2:
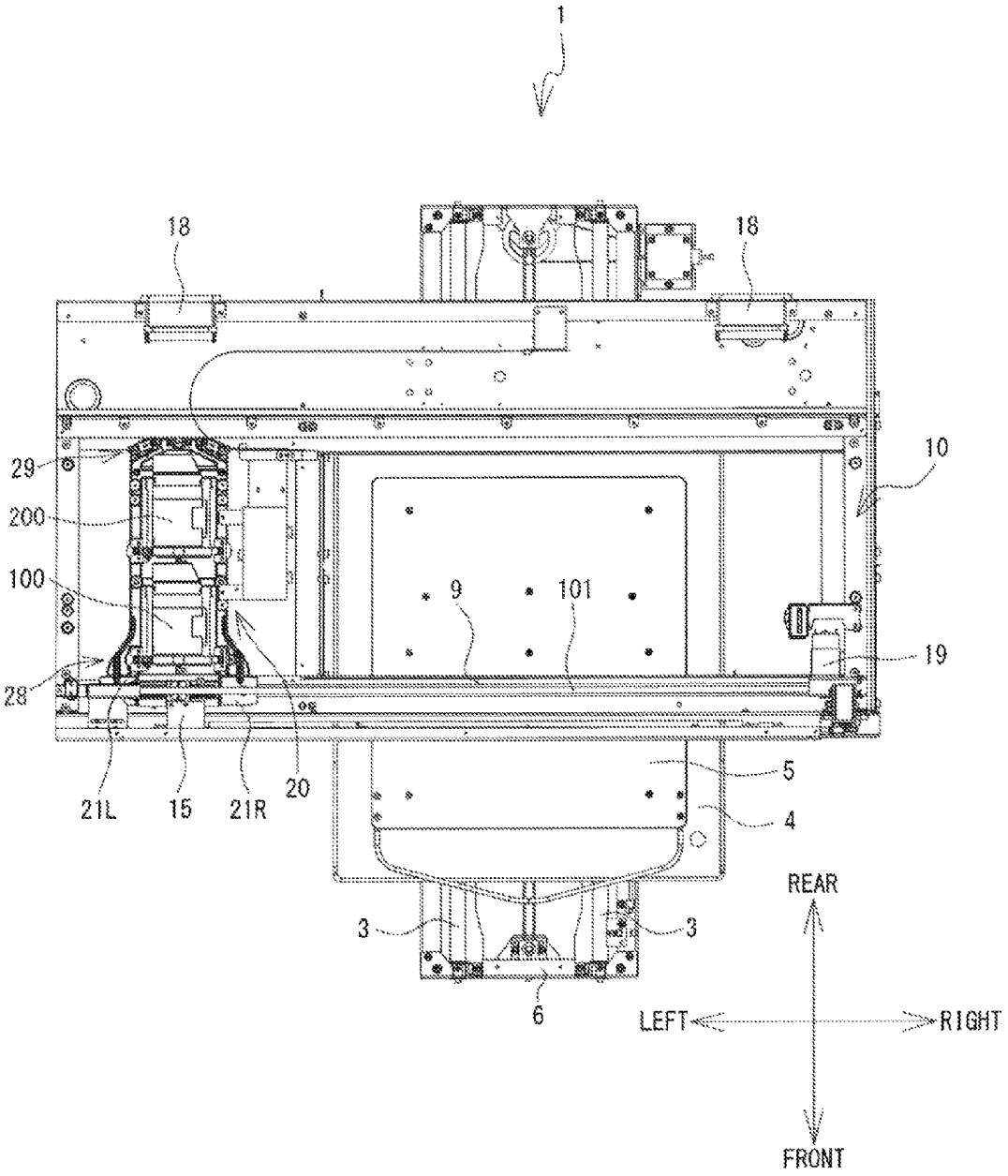
FIG. 2 is a plan view of the printer.

The platen drive mechanism 6 is provided with the pair of guide rails 3 and 3 (refer to FIG. 2). The pair of guide rails 3 and 3 support the platen 5 and the tray 4 such that the platen 5 and the tray 4 can be conveyed in the front-rear direction. The platen drive mechanism 6 uses as a driving source, a motor (not shown in the drawings) that is provided on a rear end portion of the platen drive mechanism 6, and thus moves the platen 5 and the tray 4 in the front-rear direction of the housing 2 along the pair of guide rails 3 and 3. The platen 5 has a substantially rectangular plate shape in a plan view, and its long sides extend in the front-rear direction of the housing 2. The platen 5 is provided below the frame body 10, which will be described later. The prim medium (a T-shirt, for example) made of cloth is to be placed on the top surface of the platen 5. The tray 4 has a rectangular shape in a plan view and is provided below the platen 5. When the user places a T-shirt or the like on the platen 5, the tray 4 receives a sleeve or the like of the T-shirt and thus protects it such that the sleeve or the like does not come into contact with a member of the housing 2.

The frame body 10 has a substantially rectangular frame shape in a plan view. The frame body 10 is provided on an upper portion of the housing 2. The clearance sensor 8 is provided in a position on the front side of the frame body 10 along the left-right direction of the frame body 10. The clearance sensor 8 detects obstacles, such as wrinkling of the cloth placed on the platen 5 or dirt, when the platen 5 moves in the front-rear direction inside the housing 2 along the pair of guide rails 3 and 3 during printing by the printer 1.

The frame body 10 supports the guide shaft 9 and the rail 7 on the inside of the frame body 10. The guide shaft 9 is a shaft member that is provided with a shaft-shaped portion having a center axis that extends in the second direction on the inside of the frame body 10. The rail 7 is a rod-shaped member that extends in the second direction, and is disposed facing the guide shaft 9. The guide shaft 9 and the rail 7 are separated from each other in the front-rear direction.

The carriage 20 is supported by the guide shaft 9 such that the carriage 20 can be conveyed in the left-right direction along the guide shaft 9. The support portions 21L and 21R are provided on a first carriage end portion 28, which is one end portion of the carriage 20 in the first direction. The guide shaft 9 is inserted through the support portions 21L and 21R. The support portions 211, and 21R support the carriage 20 such that the carriage 20 can slide along the guide shaft 9. In other words, the support portions 21L and 21R each have a cylindrical shape that engages with the guide shaft 9. Although not shown in the drawings, a bearing mechanism is provided inside of each of the support portions 21L and 21R. Therefore, the carriage 20 slides smoothly along the guide shaft 9. The head units 100 and 200 are mounted on the carriage 20. The bottom surfaces of the head units 100 and 200 are respectively provided with head portions 105 and 205 that can eject ink toward the print medium (refer to FIG. 8).

Although not shown in the drawings, along the left-right direction, the interior of each of the head portions 105 and 205 is divided into four sections corresponding to the respective color inks. A planar ejection surface that is parallel to the horizontal plane is formed on each of the bottom surfaces of the head portions 105 and 205. A plurality of fine ejection ports that can downwardly eject one of the color inks are provided on the ejection surface. The plurality of ejection ports are arrayed in one row in the front-rear direction from the front side of the ejection surface to the rear, and are arrayed in a plurality of rows in the left-right direction. The plurality of ejection ports correspond to a plurality of ejection channels (not shown in the drawings) that are provided inside of each of the head portions 105 and 205. The plurality of ejection channels are provided such that ink can be ejected downward from the corresponding ejection ports as a result of the driving of a plurality of piezoelectric elements (not shown in the drawings) that are provided inside of each of the head portions 105 and 205. More specifically, the head portion 105 includes an ejection port group having a plurality of ejection ports that eject black ink, an ejection port group having a plurality of ejection ports that eject cyan ink, an ejection port group having a plurality of ejection ports that eject yellow ink, and an ejection port group having a plurality of ejection ports that eject magenta ink. Further, the head portion 205 ejects white ink. The head portion 205 is divided, into four sections similarly to the head portion 105. However, the head portion 205 is configured to eject white ink from all the ejection ports. In the explanation below, the downward direction, which is the direction in which the head portions 105 and 205 of the respective head units 100 and 200 eject the ink, is also referred to as a third direction, and the upward direction that is the opposite direction to the third direction is also referred to as a fourth direction.

The drive belt 101 is strip-shaped and is stretched along the left-right direction on the inside of the frame body 10. The drive belt 101 is made of a synthetic resin having flexibility. The drive motor 19 is provided on the inside of the frame body 10, in a position on the front right side of the frame body 10. The drive motor 19 is provided between the guide shaft 9 and rail 7 in the front-rear direction. The drive motor 19 can rotate in the forward direction and the reverse direction, and is connected to the carriage 20 via the drive belt 101. When the drive motor 19 drives the drive belt 101, the carriage 20 is caused to reciprocate in the second direction. The carriage 20 causes the head portions 105 and 205 of the respective head units 100 and 200 to move in the second direction, which is the direction orthogonal to the first direction.

The board 15 is a circuit board, and its lower surface is provided with an optical sensor (not shown in the drawings) that detects a position of the carriage 20 in the second direction. The board 15 is fixed to the first carriage end portion 28 using screws. The board 15 moves in the second direction along with the reciprocal movement of the carriage 20 in the second direction. The optical sensor is electrically connected to the board 15. An encoder strip (not shown in the drawings) is disposed on the outside of and in front of the frame body 10. The encoder strip extends in a strip shape in the second direction. A pattern that indicates the position of the carriage 20 in the second direction is formed on the encoder strip. A light transmitting portion that allows light to pass through it and a light shielding portion that blocks light are alternately arranged on this pattern at an equal pitch in the longitudinal direction. A signal based on the pattern detected by the optical sensor is output to a control portion that is formed by various electronic devices installed on the board 15. This control portion acquires the position of the carriage 20 in the second direction based on the aforementioned signal. The board 15 outputs position information of the carriage 20 in the second direction to a main board (not shown in the drawings) that performs main control of the printer 1. The main board controls the driving of the drive motor 19 and the driving of the plurality of piezoelectric elements provided inside the head portions 105 and 205, based on the position information output from the board 15.

The two fans 18 and 18 are respectively provided on rear end portions of the frame body 10. The two fans 18 and 18 may be general purpose fans. The two fans 18 and 18 discharge air from the front side toward the rear side. In the present embodiment, the carriage 20 is disposed on the inside of the frame body 10. In other words, printing is performed on the print medium by the printer 1 in an area on the inside of the frame body 10. Further, the platen 5 feeds the print medium in the front rear direction inside the housing 2. Therefore, when printing is performed, there are cases in which mist is generated by ink particles in the printing area on the inside of the frame body 10, which is inside the housing 2. The mist is generated as a result of the ink ejected from the head portions 105 and 205 of the respective head units 100 and 200 becoming very small droplets. When the mist is generated, it is possible that the generated mist is dispersed inside the housing 2. The two fans 18 and 18 can discharge the mist generated in the printing area on the inside of the frame body 10, from the printing area on the inside of the frame body 10 and from inside the housing 2 toward the rear side, together with the air on the inside of the frame body 10.

Figure 3:
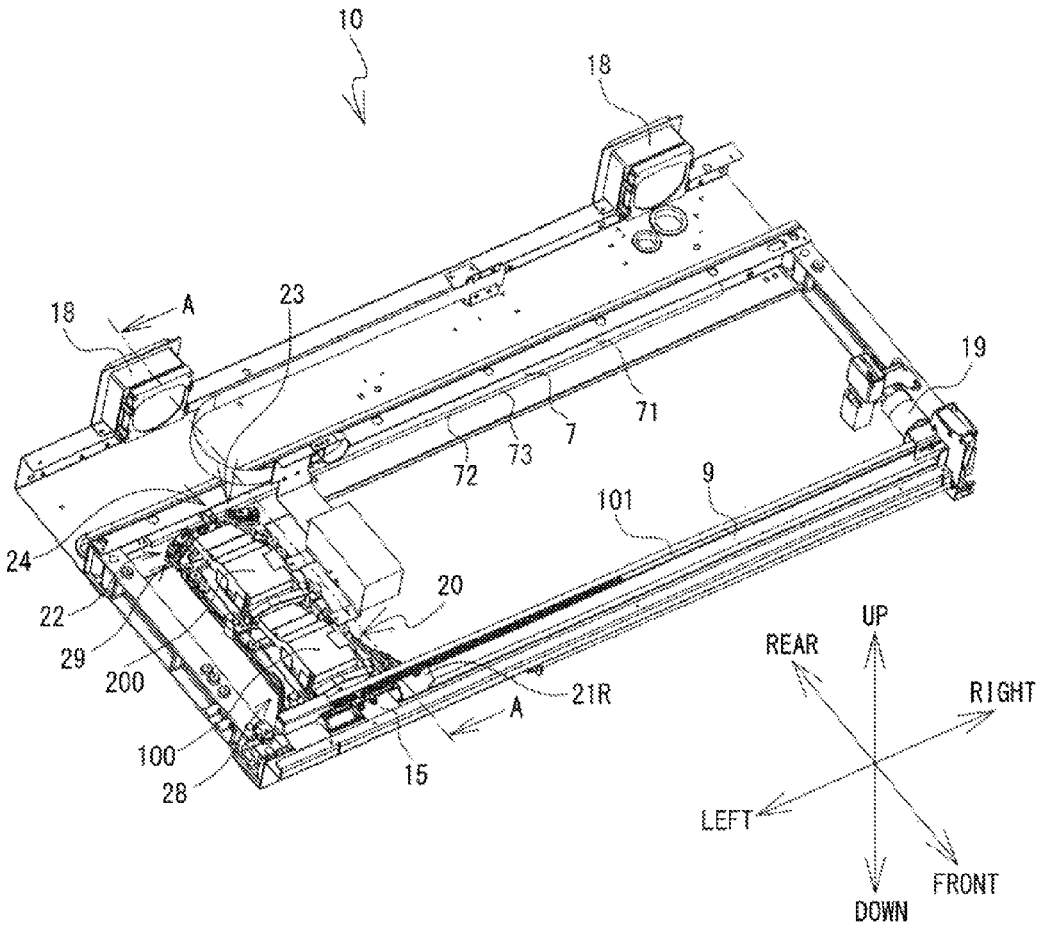
FIG. 3 is a perspective view of a frame body.

The frame body 10 will be explained in detail with reference to FIG. 3. The frame body 10 supports the guide shaft 9 on the front side and supports the rail 7 on the rear side, on the inside of the frame body 10. The carriage 20 is disposed in the front-rear direction between the guide shaft 9 and the rail 7. A left-side pressing portion 22, a right-side pressing portion 23 and a regulating portion 24 are provided on a second carriage end portion 29, which is an end portion of the carriage 20 on the opposite side to the first carriage end portion 28 (namely, the second carriage end portion 29 is on the rear side of the carriage 20). The left-side pressing portion 22 and the right-side pressing portion 23 press a front end portion 73 of the rail 7, which is on a side (the front side) facing the guide shaft 9, horizontally toward the rear side. The regulating portion 24 comes into contact with an upper end portion 71, which is an end portion of the rail 7 on the fourth direction side, and regulates the movement of the carriage 20 toward the third direction side. In other words, the second carriage end portion 29 is in contact with the rail 7 at the left-side pressing portion 22, the right-side pressing portion 23 and the regulating portion 24.

The mounted state of the head portions 105 and 205 onto the carriage 20 exerts an influence on the printing quality. Therefore, when the head portions 105 and 205 are mounted onto the carriage 20, it is necessary to perform positioning between the carriage 20 and the head portions 105 and 205 with very high precision. For example, when head portions are mounted onto the carriage 20, there are cases in which each of the head portions that ejects one type of ink is individually positioned and mounted onto the carriage 20. An operation to individually mount each of the head portions onto the carriage 20 in a narrow operation area is complicated. In the known printer, in order to secure an operation space for the user to accurately perform the mounting operation, a component corresponding to the rail 7 is disposed on the front side, which is the side near to the user, and a component corresponding to the guide shaft 9 is disposed on the rear side. In the present embodiment, the interior of each of the head portions 105 and 205 of the head units 100 and 200 is divided into four sections. In other words, the single head unit can eject four types of ink. Therefore, the operation to mount the head portions 105 and 205 onto the carriage 20 can be performed more easily than in the known art. Therefore, in the printer 1 of the present embodiment, even when the guide shaft 9 is disposed on the front side of the frame body 10 and the rail 7 is disposed on the rear side of the frame body 10, there is no need to secure an extra wide space for the operation of the user.

The head units 100 and 200 are arrayed in the first direction on the carriage 20. The head unit 100 is positioned to the front of the head unit 200. The head units 100 and 200 can reciprocate along the guide shaft 9 in the left-right direction on the inside of the frame body 10. The head unit 100 can eject the color inks and the head unit 200 can eject the white ink.

In the present embodiment, when the color of the print medium is dark, for example, before the color inks are ejected, the white ink is elected onto all or a part of the area to be printed, as a base for printing. In summary, the white ink is a pre-treatment ink. After the white ink has been ejected onto all or a part of the area to be printed, the color inks are used to print a pattern etc. on that area. In summary, each of the color inks is a post-treatment ink. In other words, the head unit 200 is a head unit for pre-treatment, and the head unit 100 is a head unit for post-treatment. Note that the white ink is also used as the post-treatment ink to print a pattern etc. In this manner, the printer 1 can perform various types of printing regardless of the color of the print medium.

If the head units 100 and 200 are arrayed in the second direction, normally, after all the printing for pre-treatment that is necessary for the print medium has been performed, the printing for post-treatment is then performed. In this case, after all the printing for pre-treatment in the printing area is completed, the platen is moved to a printing start position again, and the printing for post-treatment is performed on the printing area. Therefore, it is difficult for the user to improve production efficiency. In the present embodiment, the printer 1 performs printing by arraying the head units 100 and 200 in the first direction. In this case, the positions of the respective head units 100 and 200 in the left-right direction are the same. Therefore, by the head unit 100 electing the color inks immediately after the head unit 200 ejects the white ink, the printer 1 can perform the printing for pre-treatment and the printing for post-treatment almost simultaneously. More specifically, when the head units 100 and 200 are arranged side by side in the first direction, it is possible to perform the printing for pre-treatment and the printing for post-treatment in the same process. Thus, the printer 1 can improve production efficiency without reducing printing precision.

With regard to the pre-treatment ink and the post-treatment inks, depending on the color of the print medium and a printing image, the color inks for post-treatment need not necessarily be ejected after the white ink for pre-treatment has been ejected. More specifically, there may be an area onto which the white ink for pre-treatment only is ejected or an area onto which the color inks for post-treatment only are ejected. Further, although in the present embodiment, the white ink is used as the pre-treatment ink and the color inks are used as the post-treatment inks, the combination of the pre-treatment ink and the post-treatment inks and the ink type etc. can be changed as appropriate and are not limited to the case of the present embodiment.

Note that, it is sufficient that the printer 1 of the present embodiment is provided with at least the two head units 100 and 200. The number of the head units is not limited to the example shown in FIG. 3. For example, three or more head units that are arrayed in the first direction may be mounted on the carriage 20. Further, the form of the ejection port group that is provided on each of the head units 100 and 200 is not limited to the above-described example. For example, the head unit may be provided with a single ejection port group that ejects one type of liquid. The ejection port group that ejects the white ink and the ejection port group that ejects the color inks may be provided on the same head unit. Further, the head unit may include not only the ejection port group that ejects the white ink and/or the color inks, but also an ejection port group that ejects liquid (a discharging agent, a discharge ink or the like) other than the white ink and the color inks.

When the head units 100 and 200 are arranged side by side in the first direction on the carriage 20, the length of the carriage 20 in the front-rear direction becomes relatively long. When the carriage 20 is conveyed in the left-right direction along, the guide shaft 9, an acceleration in the left-right direction is applied to the carriage 20. The acceleration in the left-right direction that is applied to the carriage 20 exerts a load in the left-right direction on the carriage 20. The load exerted on the carriage 20 causes the carriage 20 to bend in the left-right direction, and causes an inclination in the left-right direction (the horizontal direction) from the center of the carriage 20. The first carriage end portion 28 is supported by the guide shaft 9 via the support portions 21L and 21R. Therefore, the influence of the inclination in the left-right direction that has occurred in the carriage 20 is more likely to be exerted on the second carriage end portion 29 side than on the first carriage end portion 28 side. When the influence of the inclination in the left-right direction is different between the first carriage end portion 28 side and the second carriage end portion 29 side, there is a possibility that positional displacement may occur in the left-right direction between the first carriage end portion 28 and the second carriage end portion 29. In this case, due to the influence of the acceleration in the left-right direction that is applied to the carriage 20, there is a possibility that the position of each of the head units 100 and 200 in the left-right direction is displaced from the position initially positioned by the carriage 20. As a result, a landing position of the ink ejected from each of the head units 100 and 200 onto the print medium may be displaced from a predicted landing position in the left-right direction, and the printing quality of the printer 1 may deteriorate.

In the present embodiment, the carriage 20 positions the head unit 100, which ejects the color inks (the post-treatment inks), on the first carriage end portion 28 side with respect to the head unit 200, which ejects the white ink (the pre-treatment ink). The first carriage end portion 28 is supported by the guide shaft 9 via the support portions 21L and 21R. Therefore, the first carriage end portion 28 is less likely to be affected by the inclination in the left-right direction that has occurred in the carriage 20 than the second carriage end portion 29. The printer 1 can secure the printing quality by disposing the head unit 100, which ejects the post-treatment inks that are required to be ejected more accurately than the pre-treatment ink, on the first carriage end portion 28 side, where it is less likely to be affected by the inclination in the left-right direction.

The structure of the second carriage end portion 29 will be explained in detail with reference to FIG. 4 to FIG. 7. As shown in FIG. 5, the carriage 20 includes the left-side pressing portion 22 and the right-side pressing portion 23, which are respectively disposed on both ends in the second direction of the second carriage end portion 29. In other words, the left-side pressing portion 22 is disposed on the left side of the second carriage end portion 29 and the right-side pressing portion 23 is disposed on the right side of the second carriage end portion 29. The left-side pressing portion 22 presses the rail 7 rearward, on the left side of the second carriage end portion 29. The right-side pressing portion 23 presses the rail 7 rearward, on the right side of the second carriage end portion 29. The left-side pressing portion 22 and the right-side pressing portion 23 are provided on the second carriage end portion 29, in order to reduce the inclination in the left-right direction on the second carriage end portion 29 side and to secure the printing quality.

The carriage 20 includes a lower-side pressing portion 25 and the regulating portion 24 that are disposed on the second carriage end portion 29. The lower-side pressing portion 25 is disposed between the left-side pressing portion 22 and the right-side pressing portion 23 and presses the rail 7 upward. The regulating portion 24 is disposed facing the lower-side pressing portion 25 on the fourth direction side. In addition to the weight of the carriage 20 itself, a load due to the weight of the head units 100 and 200 is applied to the carriage 20. The first carriage end portion 28 is supported by the guide shaft 9 via the support portions 21L and 21R. Therefore, it is easy for the second carriage end portion 29 to swing in the third direction (the downward direction), with the guide shaft 9 serving as a fulcrum. In order to inhibit the second carriage end portion 29 from swinging in the third direction and to secure the printing quality, the lower-side pressing portion 25 and the regulating portion 24 are provided on the second carriage end portion 29.

Figure 4:
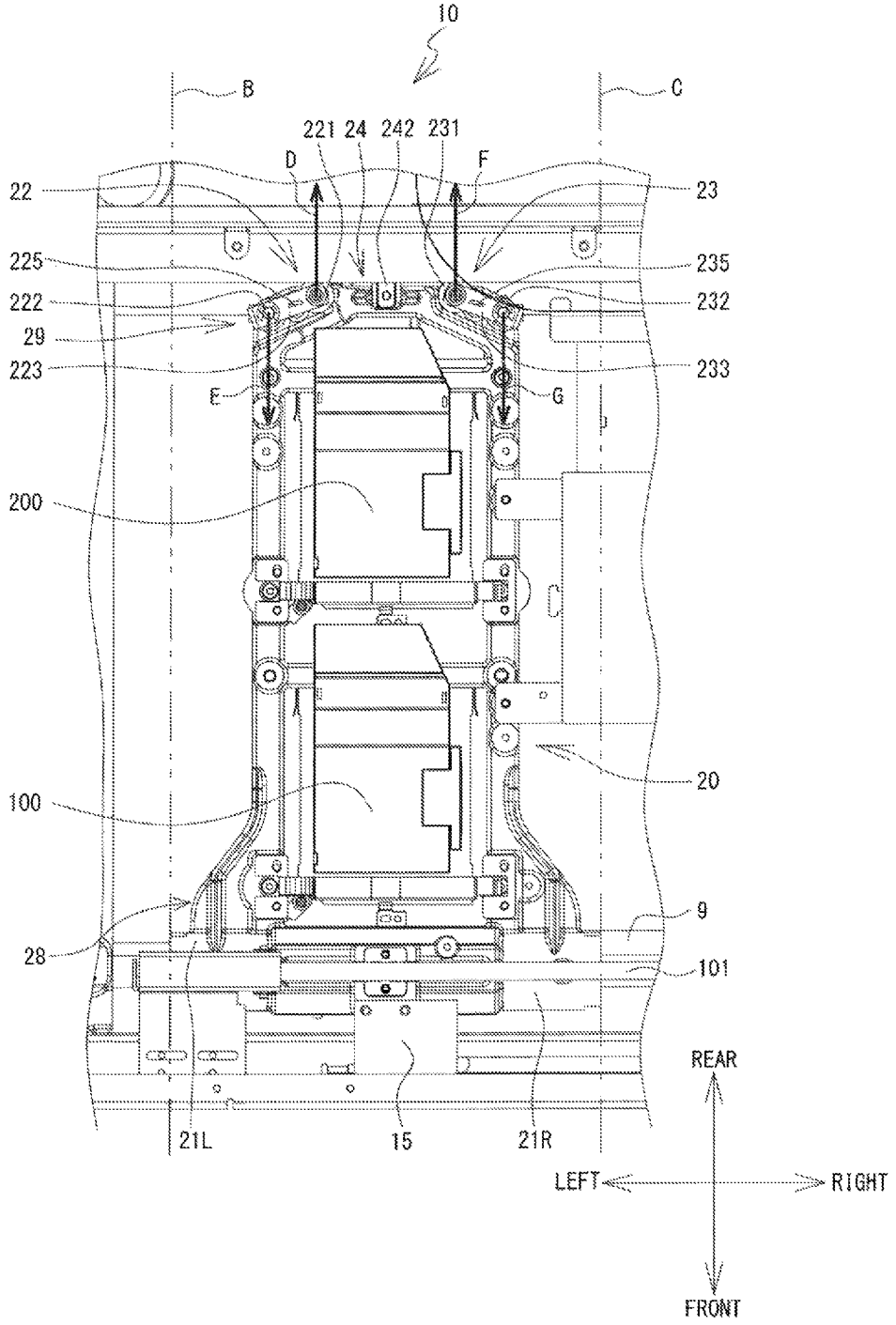
FIG. 4 is an enlarged plan view of a portion around a carriage in the frame body shown in FIG. 3.
Figure 5:
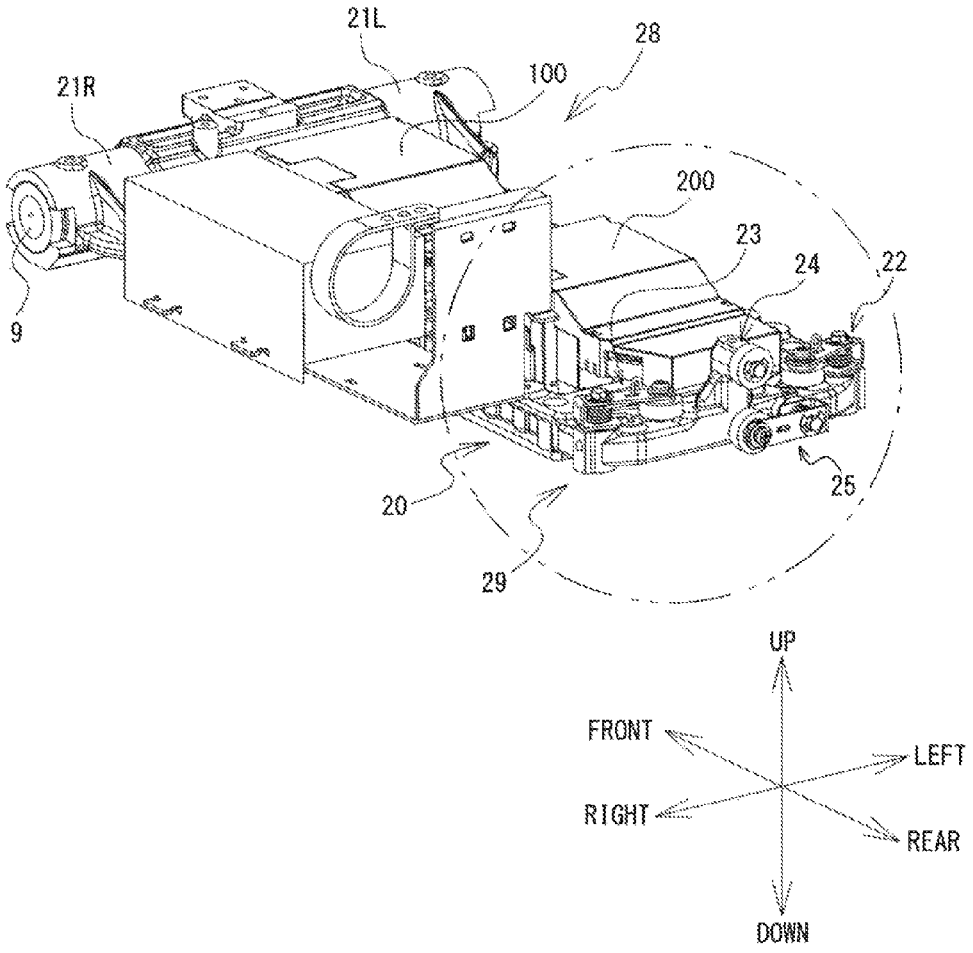
FIG. 5 is a perspective view of the carriage as viewed from the rear right side.
Figure 6:
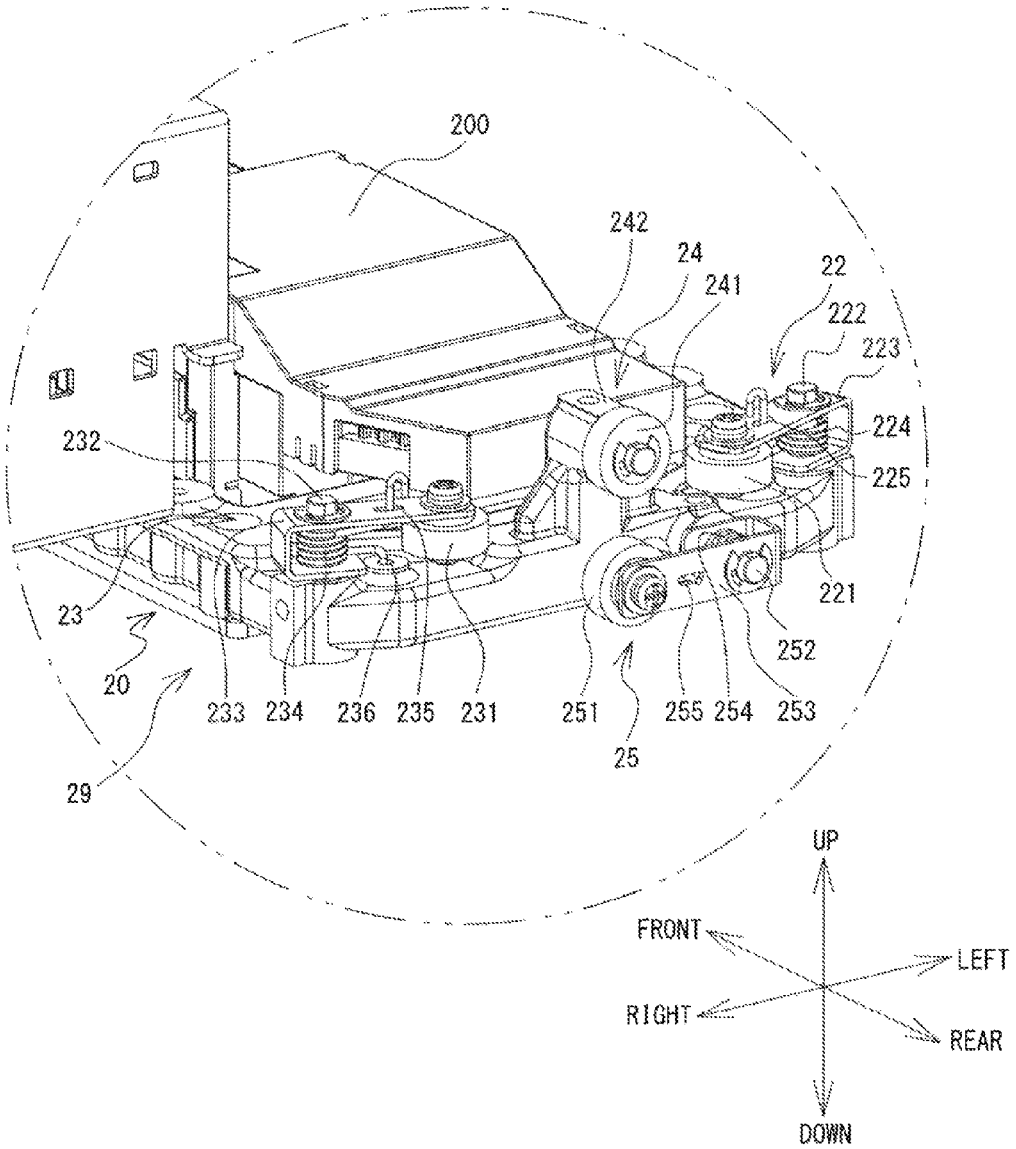
FIG. 6 is an enlarged perspective view of the carriage as viewed from the rear right side.
Figure 7:
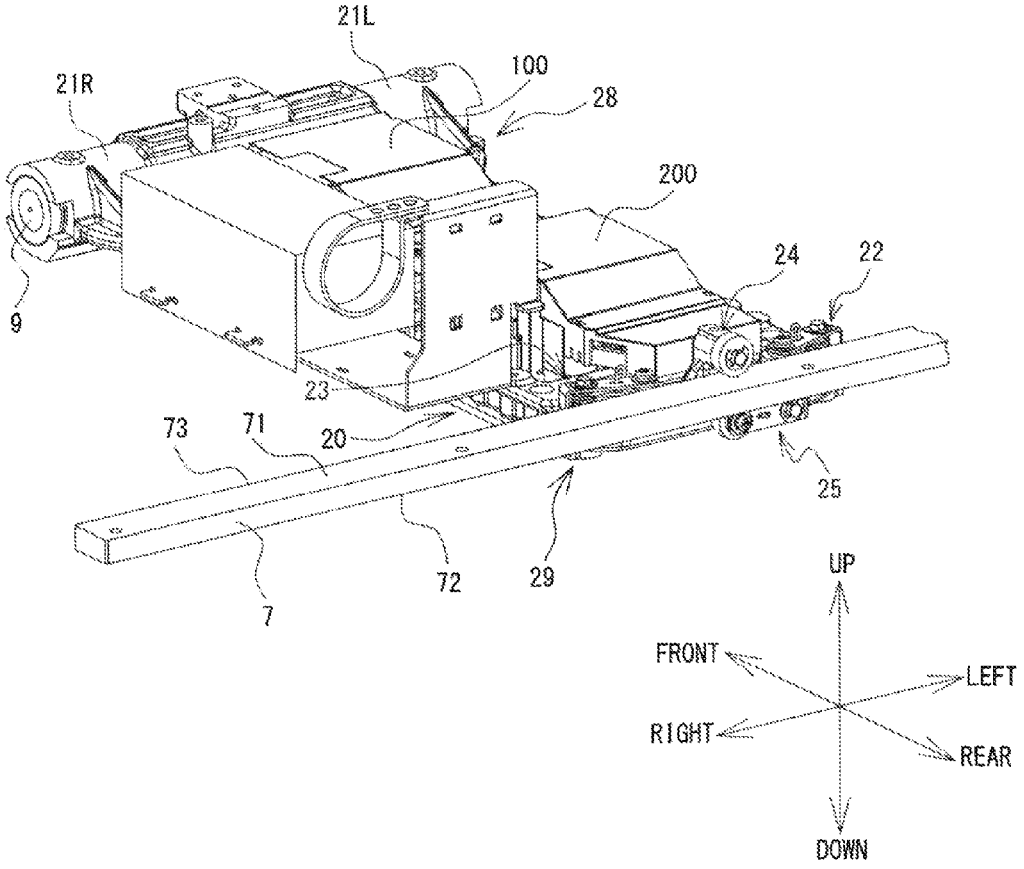
FIG. 7 is a perspective view of the carriage as viewed from the rear right side.

As shown in FIG. 4 and FIG. 6, the right-side pressing portion 23 mainly includes a support shaft 232, an arm portion 233, a contact portion 231 and a coil spring 234. The support shaft 232 is shaft-shaped and is arranged in a standing condition such that it extends in the fourth direction from the right end of the second carriage end portion 29. The support shaft 232 fixes the arm portion 233 and the coil spring 234. The arm portion 233 is provided such that it can swing around the support shaft 232. The arm portion 233 supports the contact portion 231 at an end portion on the opposite side to the support shaft 232. The contact portion 231 is cylindrically shaped and is rotatably supported at the leading end of the arm portion 233. The contact portion 231 comes into contact with the front end portion 73 of the rail 7 (refer to FIG. 3 and FIG. 7). The coil spring 234 is wound around the support shaft 232. An upper end portion of the coil spring 214 is fixed to a fixing portion 235 that is provided at the center in the longitudinal direction of the arm portion 233. A lower end portion of the coil spring 234 is fixed to a fixing portion 236 that is provided on the second carriage end portion 29. The coil spring 234 is an urging member that urges the arm portion 233 in a direction in which the contact portion 231 comes into contact with the front end portion 73.

The left-side pressing portion 22 mainly includes a support shaft 222, an arm portion 223, a contact portion 221 and a coil spring 224. The support shaft 222 is shaft-shaped and is arranged in a standing condition such that it extends in the fourth direction from the left end of the second carriage end portion 29. The support shaft 222 fixes the arm portion 223 and the coil spring 224. The arm portion 223 is provided such that it can swing around the support shaft 222. The arm portion 223 supports the contact portion 221 at an end portion on the opposite side to the support shaft 222. The contact portion 221 is cylindrically shaped and is rotatably supported at the leading end of the arm portion 223. The contact portion 221 comes into contact with the front end portion 73 of the rail 7 (refer to FIG. 3 and FIG. 7). The coil spring 224 is wound around the support shaft 222. An upper end portion of the coil spring 224 is fixed to a fixing portion 225 that is provided at the center in the longitudinal direction of the arm portion 223. A lower end portion of the coil spring 224 is fixed to a fixing portion (not shown in the drawings) that is provided on the second carriage end portion 29. The coil spring 224 is an urging member that urges the arm portion 223 in a direction in which the contact portion 221 comes into contact with the front end portion 73. The left-side pressing portion 22 has a similar structure to the right-side pressing portion 23. Note, however, that the support shaft 222, the arm portion 223, the contact portion 221 and the coil spring 224 of the left-side pressing portion 22 are arranged such that they are left-right symmetrical to the support shaft 232, the arm portion 233, the contact portion 231 and the coil spring 234 of the right-side pressing portion 23.

The lower-side pressing portion 25 mainly includes a support shaft 252, an arm portion 253, a contact portion 251 and a coil spring 254. The support shaft 252 is shaft-shaped and is arranged in a standing condition such that it extends rearward from the rear end of the second carriage end portion 29. The support shaft 252 fixes the arm portion 253 and the coil spring 254. The area portion 253 is provided such that it can swing around the support shaft 252. The arm portion 253 supports the contact portion 251 at an end portion on the opposite side to the support shaft 252. The contact portion 251 is cylindrically shaped and is rotatably supported at the leading end of the arm portion 253. The contact portion 251 comes into contact with a lower end portion 72 of the rail 7, which is on the opposite side to the upper end portion 71 of the rail 7 (refer to FIG. 3 and FIG. 7). The coil spring 254 is wound around the support shaft 252. An upper end portion of the coil spring 254 is fixed to a fixing portion 255 tint is provided at the center in the longitudinal direction of the arm portion 253. A lower end portion of the coil spring 254 is fixed to a fixing portion (not shown in the drawings) that is provided on the second carriage end portion 29. The coil spring 254 is an urging member that urges the arm portion 253 in a direction in which the contact portion 251 comes into contact with the lower end portion 72.

The regulating portion 24 mainly includes a fixed portion 242 and a contact portion 241. The regulating portion 24 is disposed facing the lower-side pressing portion 25 on the fourth direction side. The contact portion 241 is cylindrically shaped and is rotatably supported on the fixed portion 242 that stands upward from the second carriage end portion 29. The contact portion 241 comes into contact with the upper end portion 71 of the rail 7 from above (refer to FIG. 3 and FIG. 7).

As shown in FIG. 4, a pressing force (an arrow D), with which the contact portion 221 of the left-side pressing portion 22 presses the front end portion 73 (refer to FIG. 7) rearward, generates a reaction force such that the front end portion 73 presses the contact portion 221 forward. When the contact portion 221 presses the front end portion 73 rearward, the arm portion 223 moves around the support shaft 222 such that its end portion on the side provided with the contact portion 221 is directed rearward. When the contact portion 221 presses the front end portion 73 rearward, the reaction force is generated such that the front end portion 73 presses the contact portion 221 forward. The reaction force generated in the contact portion 221 is transmitted to the arm portion 223 connected to the contact portion 221. The arm portion 223 is supported by the second carriage end portion 29, with the support shaft 222 serving as a fulcrum. Therefore, the reaction force transmitted to the arm portion 223 acts in a direction in which the carriage 20 is pressed forward (an arrow E), at the position of the support shaft 222.

In a similar manner to the left-side pressing portion 22, in the right-side pressing portion 33 also, a pressing force (an arrow F), with which the contact portion 231 presses the front end portion 73 rearward, generates a reaction force such that the front end portion 73 presses the contact portion 231 forward. When the contact portion 231 presses the front end portion 73 rearward, the arm portion 233 moves around the support shaft 232 such that its end portion on the side provided with the contact portion 231 is directed rearward. When the contact portion 231 presses the front end portion 73 rearward, the reaction force is generated such that the front end portion 73 presses the contact portion 231 forward. The reaction three generated in the contact portion 231 is transmitted to the arm portion 233 connected to the contact portion 231. The arm portion 233 is supported by the second carriage end portion 29, with the support shaft 232 serving as a fulcrum. Therefore, the reaction force transmitted to the arm portion 233 acts in a direction in which the carriage 20 is pressed forward (an arrow G), at the position of the support shaft 232.

In FIG. 4, a line B is a straight line that extends in the front-rear direction along a left end portion of the support portion 21L. A line C is a straight line that extends in the front-rear direction along a right end portion of the support portion 21R. In other words, the line B indicates a position that faces the support portion 21L on the second carriage end portion 29 side. The line C indicates a position that faces the support portion 21R on the second carriage end portion 29 side. The support shaft 222 of the left-side pressing portion 22 and the support shaft 232 of the right-side pressing portion 23 are disposed on the inside of the line 13 and the line C. In other words, the support shaft 222 and the support shaft 232 are disposed on the second carriage end portion 29, between the positions that face the two support portions 21L and 21R, respectively.

The reaction force generated by the pressing force (the arrows D and F) with which the contact portions 221 and 231 press the front end portion 73 rearward is transmitted to the carriage 20. When the support shaft 222 and the support shaft 232 are disposed between the positions that face the two support portions 21L and 21R, respectively, on the second carriage end portion 29, the reaction force transmitted to the carriage 20 acts in a direction in which the first carriage end portion 28 is pressed forward (the arrows F and U), on the inside of the line B and the line C. The force acting in the direction in which the first carriage end portion 28 is pressed forward is transmitted, along the direction of the arrows E and G, toward the positions in which the support portions 21L and 21R are provided on the first carriage end portion 28. Therefore, the force is easily transmitted to the support portions 21L and 21R along the front-rear direction without any deviation in the left-right direction. More specifically, due to the reaction force transmitted toward the front where the support portions 21L and 21R are provided, the support portions 21L and 21R are easily pressed in the vertical direction with respect to the guide shaft 9 that extends in the left-right direction.

If for example, the support shaft 222 and the support shift 232 are disposed on the outer side of the line B and the line C, the positions in the left-right direction of the support portion 21L and the support shaft 222 and of the support portion 21R and the support shaft 232 do not match. In this case, the reaction force that is transmitted inside the carriage 20 toward the positions where the support portions 21L and 21R are provided is transmitted to the support portions 21L and 21R while deviation occurs in the left-right direction. Therefore, there is a possibility that the reaction force acting on the support portions 21L and 21R presses the support portions 21L and 21R in a direction deviating from the vertical direction with respect to the guide shaft 9. In this ease, there is a possibility that the left-side pressing portion 22 and the right-side pressing portion 23 cannot sufficiently reduce the inclination in the left-right direction on the second carriage end portion 29 side, and that the inclination in the left-right direction remains between the guide shaft 9 and the support portions 21L and 21R. Therefore, in the printer 1, the support shaft 222 and the support shaft 232 are disposed on the inside of the line B and the line C. Thus, the inclination in the left-right direction that occurs between the guide shaft 9 and the support portions 21L and 21R is effectively reduced. As a result, deterioration in the printing quality is suppressed. Further, since the support shaft 222 and the support shaft 232 are disposed on the inside of the line B and the line C, it is possible to reduce the size of the carriage 20 in the left-right direction.

Figure 8:
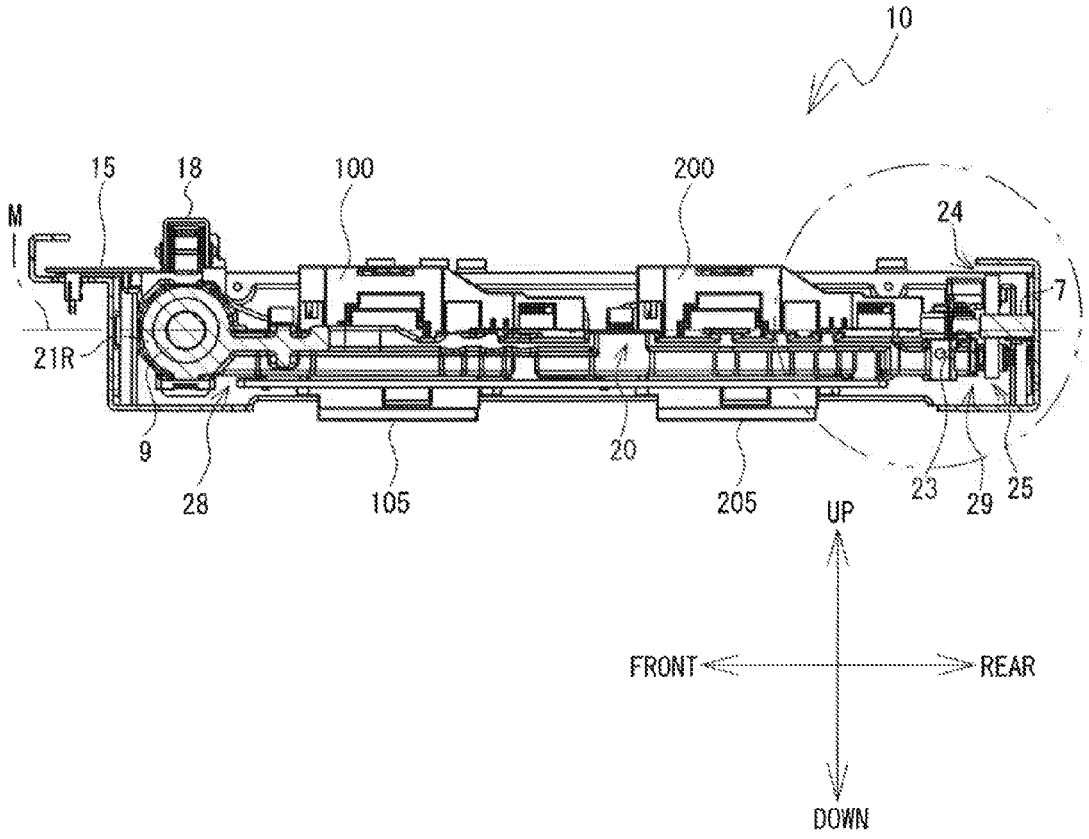
FIG. 8 is a sectional view taken on a line A-A shown in FIG. 3.

Arrangement relationships between the right-side pressing portion 23, the regulating portion 24 and the lower-side pressing portion 25 in the second carriage end portion 29 will be explained in detail with reference to FIG. 8 and FIG. 9. As shown in FIG. 8, a line M is a straight line that passes through the center of the guide shaft 9 and extends in the horizontal direction. In other words, the line M indicates a position, in the up-down direction, of the center of the guide shaft 9.

A design tolerance is provided between the guide shaft 9 and the support portions 21L and 21R. Therefore, in a state in which the guide shaft 9 is inserted through the support portions 21L and 21R, slight wobble may occur in the carriage 20. The reaction force from the front end portion 73, which acts in a direction in which the first carriage end portion 28 is pressed toward the guide shaft 9, presses the support portions 21L and 21R toward the guide shaft 9. When the support portions 21L and 21R are pressed forward toward the guide shaft 9, a slight gap between the rear side of the guide shaft 9 and the support portions 21L and 21R is eliminated. It is therefore possible to reduce the slight wobble that occurs in the carriage 20. Further, since the support portions 21L and 21R are pressed against the guide shaft 9, it is also possible to reduce the inclination in the left-right direction that occurs during movement of the carriage 20. Note that the reaction force from the from end portion 73 acts in the same manner also on the contact portion 221 of the left-side pressing portion 22 that presses the front end portion 73 rearward.

Figure 9:
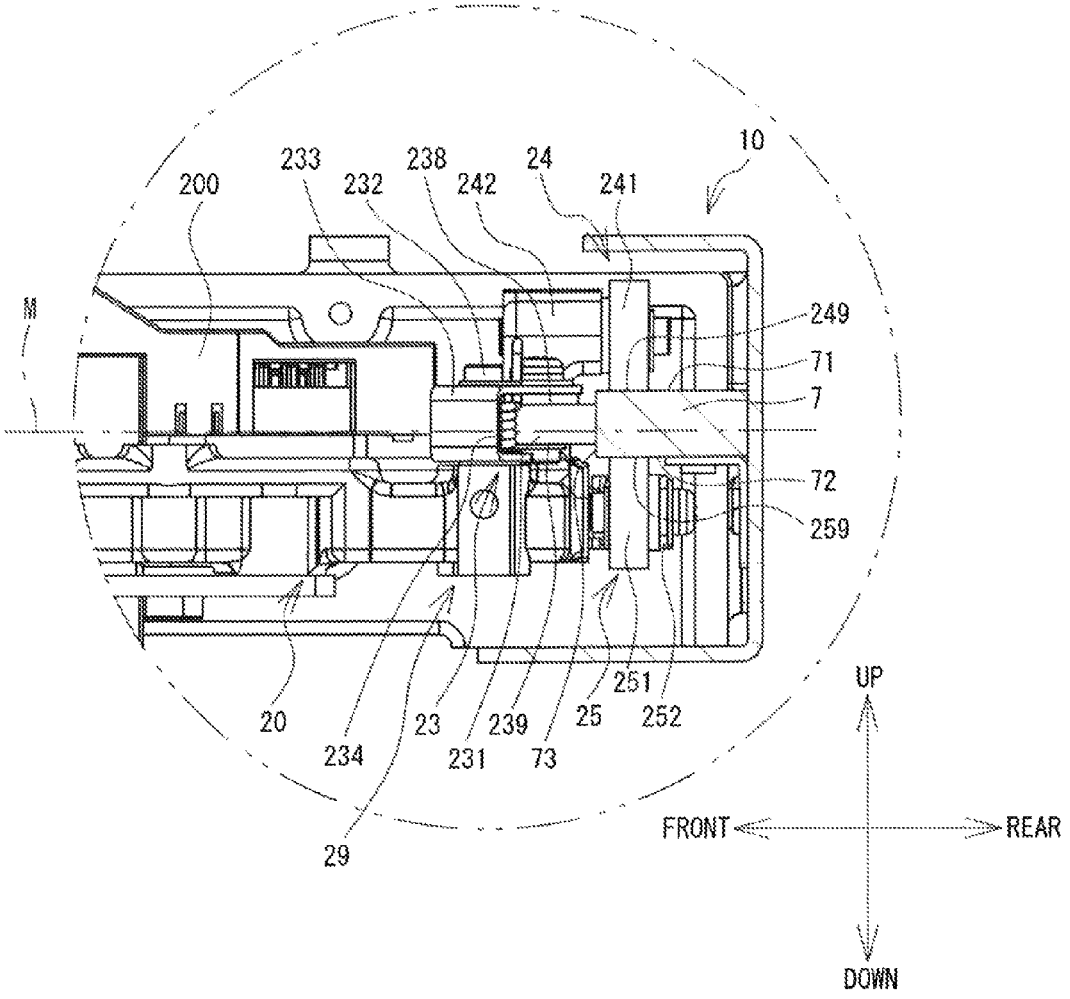
FIG. 9 is an enlarged sectional view of a rear portion of the frame body shown in FIG. 8.

As shown in FIG. 9, the line M extends in the horizontal direction between an end portion 238, which is an end portion on the third direction side of the contact portion 231, and an end portion 239, which is an end portion on the fourth direction side of the contact portion 231. In other words, the center of the guide shaft 9 is disposed between the end portion 238 and the end portion 239 in the up-down direction. In this case, the reaction force from the front end portion 73 that acts in a direction in which the support portions 21L and 21R are pressed toward the guide shaft 9 is easily transmitted toward the center of the guide shaft 9 horizontally along the front-rear direction. More specifically, the pressing force with which the reaction force from the front end portion 73 presses the support portions 21L and 21R toward the guide shaft 9 efficiently acts on the center of the guide shaft 9, at the same height as the guide shaft 9 in the up-down direction. In this case, the support portions 21L and 21R are pressed toward the center of the guide shaft 9, and the slight wobble that occurs in the carriage 20 and the inclination in the left-right direction that occurs during movement of the carriage 20 are reduced. More specifically, since the center of the guide shaft 9 is disposed between the end portion 238 and the end portion 239, it is possible to more effectively reduce the slight wobble that occurs in the carriage 20 and the inclination in the left-right direction that occurs during movement of the carriage 20. The right-side pressing portion 23 and the left-side pressing portion 22 can reliably support the carriage 20 in the front-rear direction.

As shown in FIG. 9, in the second carriage end portion 29, the regulating portion 24 is disposed on the fourth direction side of the lower-side pressing portion 25 such that the regulating portion 24 faces the lower-side pressing portion 25. An end portion 249 on the third direction side (the lower side) of the contact portion 241 cones into contact with the upper end portion 71 from above. The end portion 249 is disposed on the fourth direction side (the upper side) with respect to the line M. In this case, the front end portion 73 that is formed between the upper end portion 71 and the lower end portion 72 is easily disposed in the same position as the line M in the up-down direction. When the front end portion 73 is disposed in the same position as the line M in the up-down direction, the contact portion 231 that presses the front end portion 73 is also easily disposed in the same position as the line M in the up-down direction. Therefore, the pressing force with which the reaction force from the front end portion 73 presses the support portions 21L and 21R toward the guide shaft 9 is more reliably transmitted to the center of the guide shaft 9.

Here, as described above, the first carriage end portion 28 side of the carriage 20 is engaged with the guide shaft 9 at the support portions 21L and 21R. Since the head units 100 and 200 are disposed on the carriage 20, the load due to the weight of the head units 100 and 200 is applied to the carriage 20 in the downward direction, in addition to the load due to the weight of the carriage 20 itself. The first carriage end portion 28 is supported by the guide shaft 9 via the support portions 21L and 21R. Therefore, it is easy for the second carriage end portion 29 to swing downward, with the center of the guide shaft 9 serving as a fulcrum.

In the present embodiment, the end portion 249 comes into contact with the upper end portion 71 from above, and thus regulates the downward movement of the carriage 20. In other words, the contact portion 241 positions the end portion 249 above the line M. An upper end portion 259 of the contact portion 251 of the lower-side pressing portion 25 comes into contact with the lower end portion 72. That is, the rail 7 is clamped by the contact portion 241 and the contact portion 251 in the up-down direction. The contact portion 251 is urged by the arm portion 253 in the direction in which the contact portion 251 comes into contact with the lower end portion 72. In the second carriage end portion 29, the urged contact portion 251 presses the carriage 20 toward the lower end portion 72. Since the position of the second carriage end portion 29 in the up-down direction is positioned by the end portion 249 of the contact portion 241, the contact portion 251 can reliably press the carriage 20 upward toward the lower end portion 72. The pressing force with which the contact portion 251 presses the lower end portion 72 upward acts M a direction to cancel out the downward swing of the second carriage end portion 29 with the center of the guide shaft 9 serving as the fulcrum. That is, the carriage 20 can be reliably supported in the up-down direction by the regulating portion 24 and the lower-side pressing portion 25.

As explained above, the left-side pressing portion 22 and the right-side pressing portion 23 that are provided on the second carriage end portion 29 urge the arm portions 223 and 233 in the direction in which the contact portions 221 and 231 come into contact with the front end portion 73. The contact portions 221 and 231 press the front end portion 73 rearward. In this case, the reaction force to the pressing force by the left-side pressing portion 22 and the right-side pressing portion 23 is applied to the carriage 20. The reaction force applied to the carriage 20 acts in the direction in which the carriage 20 is pressed forward toward the guide shaft 9. Therefore, it is possible to reduce the inclination of the carriage 20 when the carriage 20 is conveyed in the left-right direction and the wobble of the carriage 20 with respect to the guide shaft 9. In other words, it is possible to inhibit the priming quality from deteriorating due to the displacement of the landing position of the ink ejected from the head portions 105 and 205 of the head units 100 and 200 with respect to the print medium, which is caused by the inclination of the carriage 20 and the wobble of the carriage 20.

The center of the guide shaft 9 is disposed between the end portion 238 and the cud portion 239. In this case, the reaction force to the pressing force with which the left-side pressing portion 22 and the right-side pressing portion 23 press the front end portion 73 is easily transmitted toward the center of the guide shaft 9 horizontally along the front-rear direction. Therefore, the left-side pressing portion 22 and the right-side pressing portion 23 can reliably support the carriage 20 in the front-rear direction.

In the first carriage end portion 28, the two support portions 21L and 21R are provided so that the carriage 20 is supported to the guide shaft 9. Therefore, in comparison to the second carriage end portion 29 side, the first carriage end portion 28 side is less likely to be affected by the inclination of the carriage 20 and the wobble of the carriage 20. The head unit 100, which ejects the color inks for post-treatment in order to draw a pattern etc. after the head unit 200 has ejected the white ink for pre-treatment, is required to eject ink with a higher degree of accuracy than the head unit 200. The head unit 200 is disposed on the first carriage end portion 28 side, which is less likely to be affected by the inclination of the carriage 20 and the wobble of the carriage 20. It is thus possible to secure the printing quality.

The first carriage end portion 28 is supported by the support portions 21L and 21R through which the guide shaft 9 is inserted. In addition to the weight of the carriage 20 itself, the load due to the weight of the head units 100 and 200 is applied to the carriage 20. Therefore, it is easy for the second carriage end portion 29 to swing downward with the guide shaft 9 serving as the fulcrum. In the second carriage end portion 29, the lower-side pressing portion 25 can press the carriage 20 toward the lower end portion 72. The pressing force with which the lower-side pressing portion 25 presses the carriage 20 toward the lower end portion 72 acts in the direction to cancel out the force that causes the second carriage end portion 29 to swing downward. Further, the regulating portion 24 comes into contact with the upper end portion 71 from above. Thus, the rail 7 is clamped from above and below by the contact portion 241 and the contact portion 251. Therefore, by providing the regulating portion 24 and the lower-side pressing portion 25, it is possible to reliably support the carriage 20 in the up-down direction.

The end portion 249 of the regulating portion 24 is disposed above the center of the guide shaft 9. In this ease, the front end portion 73 that is formed between the upper end portion 71 and the lower end portion 72 is easily disposed in the same position as the center of the guide shaft 9 in the up-down direction. Therefore, the left-side pressing portion 22 and the right-side pressing portion 23 can reliably press the carriage 20 forward toward the center of the guide shaft 9. Further, the regulating portion 24 comes into contact with the upper end portion 71 from above, and thus regulates the downward movement of the carriage 20. Therefore, the lower-side pressing portion 25 can reliably press the carriage 20 upward against the lower end portion 72.

Note that the present disclosure is not limited to the above-described embodiment and various modifications are possible. For example, it is sufficient that the head unit 100 and the head unit 200 are arranged side by side in the front-rear direction. The two head units 100 and 200 need not necessarily be arranged in a straight line in the front-rear direction. For example, the positions of the head unit 100 and the head unit 200 may be displaced from each other in the left-right direction in a so-called zigzag arrangement, within a range in which the printing for pre-treatment and the printing for post-treatment can be performed in the same process. Further, in the above-described embodiment, the interior of each of the head portions 105 and 205 is divided into four sections along the left-right direction corresponding to the respective color inks. However, the number of the divided sections may be changed as appropriate from that described above.

The liquid supplied to the head units 100 and 200 is not limited to the above-described example. For example, the liquid may be ink of another color, such as gold, silver or the like. Further, for example, a treating agent to improve ink fixing may be used instead of the pre-treatment ink of the above-described embodiment, and a color ink may be used as a post-treatment liquid. For example, in discharge printing, a discharging, agent may be used instead of the pre-treatment ink of the above-described embodiment, and a discharge ink may be used instead of the post-treatment ink of the above-described embodiment. In other words, it is sufficient that the liquid that cam be ejected by the head units 100 and 200 is a liquid having characteristics, such as viscosity etc., that allow ejection from the head units 100 and 200. Therefore, the liquid is not limited to ink, and may be a chemical agent, such as a decoloring agent, for example. Further, as another example, the pre-treatment liquid and the post-treatment liquid may be the same type of liquid.

In the above-described embodiment, the single lower-side pressing portion 25 is provided, it is preferable that the number of the lower-side pressing portions 25 be one, if two or more of the lower-side pressing portions 25 are provided, it is possible that some of the two or more lower-side pressing portions 25 may not come into contact with the lower end portion 72 due to a design tolerance or the like. In this case, it is possible that wobble may occur between the two or more lower-side pressing portions 25 and it may become difficult to support the second carriage end portion 29 horizontally. However, if all of the two or more lower-side pressing portions 25 can uniformly come into contact with the lower end portion 72, the two or more lower-side pressing portions 25 may be provided.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer configured to perform printing by ejecting liquid onto a print medium that is fed in a first direction, the printer comprising:

a guide shaft being a shaft member having a center axis extending along a second direction, the second direction being a direction orthogonal to the first direction;

a rail member disposed facing the guide shaft, the rail member being a rod-shaped member extending in the second direction;

a plurality of print head units, each of the plurality of print head units having an ejection portion configured to eject the liquid toward the print medium;

a carriage configured to arrange the plurality of print head units in the first direction and also configured to cause the plurality of print head units to reciprocate in the second direction, the carriage including two support portions, each of the two support portions being provided on a shaft-side end portion, the shaft-side end portion being one end portion of the carriage in the first direction, such that the carriage is slidably supported along the guide shaft by the guide shaft being inserted through each of the two support portions; and a first pressing portion provided on a rail-side end portion, the rail-side end portion being on an opposite side to the shaft-side end portion of the carriage in the first direction, such that the first pressing portion presses a first end portion of the rail member, the first end portion facing the guide shaft;

wherein the first pressing portion includes a first contact member provided so as to come into contact with the first end portion, a first support shaft disposed between a position of the rail-side end portion facing one of the two support portions and a position of the rail-side end portion facing the other of the two support portions, the first support shaft standing in a fourth direction opposite to a third direction in which the ejection portion ejects the liquid, a first arm member supported so as to swing around the first support shaft, the first arm member being provided so as to support the first contact member on a swinging end side opposite to a first support shaft side thereof, and a first urging member provided so as to urge the first arm member in a direction in which the first contact member comes into contact with the first end portion.

2. The printer according to claim 1, wherein the guide shaft is disposed such that a center of the guide shaft is positioned between an end portion on the third direction side of the first contact member and an end portion on the fourth direction side of the first contact member.

3. The printer according to claim 1, wherein the plurality of print head units include a first head unit having the ejection portion configured to eject a pre-treatment liquid onto the print medium and a second head unit having the ejection portion configured to eject a post-treatment liquid, the post-treatment liquid being a liquid that is to be ejected onto the print medium onto which the pre-treatment liquid has been ejected by the first head unit, and the carriage is configured to arrange the second head unit on the shaft-side end portion side with respect to the first head unit.

4. The printer according to claim 1, further comprising:

a second pressing portion provided on the rail-side end portion; and a regulating portion disposed facing the second pressing portion on the fourth direction side, the regulating portion being configured to regulate movement of the carriage in the third direction by coming into contact with a second end portion provided on the fourth direction side of the rail member;

wherein the first pressing portion is provided on each of both ends of the rail-side end portion in the second direction, and the second pressing portion is disposed between the two first pressing portions, and the second pressing portion includes a second contact member provided to come into contact with a third end portion, the third end portion being an end portion of the rail member opposite to the second end portion, a second arm member supported so as to swing around a second support shaft standing in the first direction, the second arm member being provided so as to support the second contact member on a swinging end side opposite to the second support shaft, and a second urging member provided so as to urge the second arm member in a direction in which the second contact member comes into contact with the third end portion.

5. The printer according to claim 4, wherein an end portion on the third direction side of the regulating portion is disposed on the fourth direction side with respect to a center of the guide shaft.

* * * * *